United States Patent [19]

Tsuji

[11] Patent Number: 4,499,975

[45] Date of Patent: Feb. 19, 1985

[54] CONTROL APPARATUS FOR ELEVATORS

[75] Inventor: Shintaro Tsuji, Nagoya, Japan

[73] Assignee: Mitsubishi Denki Kabushiki Kaisha, Japan

[21] Appl. No.: 562,006

[22] Filed: Dec. 16, 1983

[30] Foreign Application Priority Data

Dec. 22, 1982 [JP] Japan ..... 57/225308

[51] Int. Cl.[3] ..... B66B 1/18

[52] U.S. Cl. ..... 187/29 R

[58] Field of Search ..... 187/29

[56] References Cited

U.S. PATENT DOCUMENTS 4,044,860 8/1977 Kaneko et al. ..... 187/29 R 4,355,705 10/1982 Schröder et al. ..... 187/29 R 4,411,338 10/1983 Kuzunuki et al. ..... 187/29 R

*Primary Examiner*—J. V. Truhe

*Assistant Examiner*—W. E. Duncanson, Jr.

*Attorney, Agent, or Firm*—Leydig, Voit, Osann, Mayer and Holt, Ltd.

[57] ABSTRACT

A control apparatus for elevators in which one cycle of a fluctuating demand is divided into a plurality of sections, the demand in each section or a service condition value of the elevators for the demand is measured, the demand or the service condition value of the corresponding section is estimated from the measured value, the estimated value is compared with a measured value obtained anew, so that when both the values have not been decided to differ greatly as the result of the comparison, cages may be controlled by the use of an estimative value obtained by considering the measured value obtained anew, whereas when both the values have been decided to differ greatly as the result of the comparison, the cages may be controlled by the use of the estimated value obtained without considering the measured value obtained anew, and measurement value analyzing means is comprised for analyzing the measured values differing greatly from the estimated value, in the same section, so that when a permanent change in the demand or the service condition has been noted as the result of the analysis, the cages may be controlled by the use of the estimated value obtained by considering the measured value differing greatly from the estimated value. Thus, the estimative value is caused to quickly follow up the fluctuation of the demand or the service condition value, and the responsiveness of the cages to the new demand or service condition value can be improved.

10 Claims, 11 Drawing Figures

FIG. 4

33

| | |
|---|---|
| 41 | TIME |
| 42 | LDU |
| 43 | LDD |
| 44 | J |
| 45 | X |
| 46 | DAY |
| 47 | PU(1) |
| 48 | PU(2) |
| 49 | PU(3) |
| 50 | PD(1) |
| 51 | PD(2) |
| 52 | PD(3) |
| 53 | PUL(1) |
| 54 | PUL(2) |
| 55 | PUL(3) |
| 56 | PDL(1) |
| 57 | PDL(2) |
| 58 | PDL(3) |
| 59 | N(1) |
| 60 | N(2) |
| 61 | N(3) |
| 62 | FLAG(1) |
| 63 | FLAG(2) |
| 64 | FLAG(3) |
| 65 | DAYX(1) |
| 66 | DAYX(2) |
| 67 | DAYX(3) |

FIG. 5

34

| | |
|---|---|
| 71 | T1 |
| 72 | T2 |
| 73 | T3 |
| 74 | T4 |
| 75 | SA |
| 76 | L |
| 77 | PU1 |
| 78 | PU2 |
| 79 | PU3 |
| 80 | PD1 |
| 81 | PD2 |
| 82 | PD3 |
| 83 | M |
| 84 | N |
| 85 | Q |

95
ENTER
95A 95B
131
TIME = T1 ?
YES
NO
135
TIME = T2 ?
YES
NO
137
TIME = T3 ?
YES
NO
139
NO
TIME = T4 ?
YES
140
J ← 3
138
J ← 2
136
J ← 1
X ← {PUL(J) − PU(J)}² + {PDL(J) − PD(J)}²
141
142
X ≧ L ?
NO
YES
144
FLAG(J) ← 1
143
FLAG(J) ← 0
145
FLAG(J) = 1 ?
NO
YES
146
N(J) ← N(J) + 1
147
DAYX(J) ≧ 1 ?
NO
YES
148
DAYX(J) ← DAYX(J) + 1
151
N(J) ≧ N ?
NO
YES
149
NO
DAYX(J) ≧ Q ?
YES
150
DAYX(J) ← 0
152
DAYX(J) ← 1
132
DAY ← DAY + 1
133
DAY > M
NO
YES
DAY ← 1
N(1) ← 0
N(2) ← 0
N(3) ← 0
134
EXIT

CONTROL APPARATUS FOR ELEVATORS

BACKGROUND OF THE INVENTION

This invention relates to a control apparatus for elevators wherein a traffic demand or service condition concerning the elevators within a building as fluctuates depending upon time zones is estimated so as to control cages with the estimated value.

The traffic volume of elevators in a building (hereinbelow, termed "demand") fluctuates irregularly when closely observed within a period of one day, but presents similar aspects for similar time zones when observed over several days. In, for example, an office building, elevator passengers on their way to their office floors crowd on the first floor during a short period of time in the time zone in which they attend offices in the morning. In the first half of the lunch hour, many passengers go from the office floors to a restaurant floor, while in the latter half thereof, many passengers go from the restaurant floor and the first floor to the office floors. Further, many passengers go from the office floors to the first floor in the time zone in which they leave the offices in the evening. The volumes of traffic in the up direction and in the down direction are nearly equal in the daytime time zones other than mentioned above, while the volume of traffic becomes very small throughout the nighttime.

In order to deal with the traffic in the building changing in this manner by means of a limited number of elevators, the elevators are usually operated under group supervision. One of the important roles of the group supervision of the elevators is to assign an appropriate elevator to each hall call registered. Various assignment systems for the hall calls have been proposed. By way of example, there has been considered a system wherein, when a hall call is registered anew, it is tentatively assigned to respective elevators, and the waiting times of all hall calls, the possibility of the full capacity of passengers, etc. are predicted to calculate service evaluation values for all the cases, from among which the appropriate elevator is selected. In order to execute such predictive calculations, traffic data peculiar to each building is required.

For example, data on the number of passengers who get on and off the cage of each elevator at intermediate floors is required for predicting the possibility of the full capacity. When such traffic data which changes every moment is stored each time, an enormous memory capacity is necessitated, which is not practical. It is therefore common practice to reduce the required memory size by dividing the operating period of time in one day into several time zones and storing only the average traffic volumes of the respective time zones. Soon after the completion of the building, however, there is a high possiblity that the traffic data will change in accordance with changes in personnel organization in the building, and hence, it is difficult to obtain good traffic data with which the demand can be predicted accurately. For this reason, there has been thought out a system wherein traffic conditions in the building are detected so as to sequentially improve traffic data.

More specifically, the operating period of time in one day is divided into K time zones (hereinbelow, termed "sections"), and a time (hereinbelow, termed "boundary") by which a section $k-1$ and a section k are bounded is denoted by $t_k$ ($k=2, 3, \ldots K$). Times $t_1$ and $t_{k+1}$ are the starting time and end time of the elevator operation, respectively. The average traffic volume $P_k(l)$ of the section k on the l-th day can be expressed by the following equation (1):

$$P_k(l) = \frac{1}{t_{k+1} - t_k} \begin{bmatrix} X_k^u(l) \\ X_k^d(l) \\ Y_k^u(l) \\ Y_k^d(l) \end{bmatrix} \tag{1}$$

Here, $X_k^u(l)$ is a column vector of $(F-1)$ dimensions (where F denotes the number of floors) the elements of which are the number of passengers to get on cages in the up direction at the respective floors in the time zone k of the l-th day. Similarly, $X_k^d(l)$, $Y_k^u(l)$ and $Y_k^d(l)$ are column vectors which indicate the number of passengers to get on the cages in the down direction, the number of passengers to get off the cages in the up direction and the number of passengers to get off the cages in the down direction, respectively. The average traffic volume $P_k(l)$ (hereinbelow, termed "average demand") is measured by a passenger-number detector which utilizes load changes during the stoppage of the cages of the elevators and/or industrial television, ultrasonic wave, or the like.

First, it will be considered to sequentially correct the representative value of the average demand $P_k(l)$ of each time zone in a case where the boundary $t_k$ which is the time zone demarcating time is fixed.

It is thought that the columns $\{P_k(\mathbf{1}), P_k(\mathbf{2}), \ldots\}$ of the average demands occurring daily will disperse in the vicinity of a certain representative value $P_k$. Since the magnitude of the representative value $P_k$ is unknown, it needs to be estimated by any method. In this case, there is the possibility that the magnitude itself of the representative value $P_k$ will change. The representative value is therefore predicted by taking a linear weighted average given in equations (2) and (3) below and attaching more importance to the average demand $P_k(l)$ measured latest, then to the other average demands $P_k(\mathbf{1})$, $P_k(\mathbf{2})$, . . . and $P_k(l-1)$.

$$P_k(l) = (1-a)^l P_k(O) + \sum_{i=1}^{l} \lambda_i P_k(i) \tag{2}$$

$$\lambda_i = a(1-a)^{l-i} \tag{3}$$

Here, $P_k(l)$ is the representative value which has been predicted from the average demands $P_k(\mathbf{1}), \ldots$ and $P_k(l)$ measured till the l-th day, and $P_k(\mathbf{0})$ is an initial value which is set to a suitable value and is set in advance. $\lambda_i$ denotes the weight of the average demand $P_k(i)$ measured on the i-th day, and this weight changes depending upon a parameter a. More specifically, an increase in the value of the parameter a results in an estimation in which more importance is attached to the latest measured average demand $P_k(l)$ than to the other average demands $P_k(\mathbf{1}), \ldots$ and $P_k(l-1)$, and in which the predictive representative value $P_k(l)$ quickly follows up the change of the representative value $P_k$.

However, when the value of the parameter a is too large, it is feared that the predictive representative value will change too violently in a manner to be influenced by the random variations of daily data. Meanwhile, equations (2) and (3) can be rewritten as follows:

$$P_k(l) = (1-a)P_k(l-1) + a\,P_k(l) \tag{4}$$

$$P_k(0)=P_k(0) \quad (5)$$

In accordance with the above equation (4), there is the advantage that the weighted average of equation (2) can be calculated without storing the observation values $P_k(i)(i=1, 2, \ldots, l-1)$ of the average demands in the past.

In order to prevent the estimated value of the traffic demand of each time zone from being adversely affected by traffic on Sunday, a national holiday or the like different from an ordinary day or by temporarily-increasing nonregular traffic as in the case of the starting or end of a conference in a building having an assembly hall into which many people gather abruptly, there has been considered a system according to which a measured result $P_k(l)$ is not used for the estimation of the average demand when the measured result $P_k(l)$ differs greatly from the estimative value $P_k(l-1)$ of the average demand estimated till then. By way of example, the norm X of the estimated value $P_k(l-1)$ and the measured result $P_k(l)$ is calculated in accordance with equation (6) below, it is decided for the norm $X \geqq$ a constant value L that the measured result $P_k(l)$ is the measured result of the average demand on the day different from the ordinary day, and the estimative value $P_k(l)$ of the average demand according to equation (4) is not calculated.

$$X=||P_k(l-1)-P_k(l)||^2 \quad (6)$$

However, in a case where the organization of the personnel in the building has permanently greatly changed the norm X according to equation (6) always becomes $X \geqq$ the constant value L, and the measured result $P_k(l)$ of the average demand is decided to be the measured result of the average demand on the day different from the ordinary day. This has led to the drawback that the estimative value $P_k(l)$ of the new traffic demand is not calculated foreover, the predictive calculation of the waiting time, the possibility of full capacity or the like becomes erroneous, and the elevators are not group-supervised as intended.

Besides the traffic demand referred to above, such as the numbers of passengers getting on or off the cages or the numbers of hall calls; data expressive of a service condition such as waiting times on the halls, ride times in the cages, the number of times of passage due to the full capacity or the correct rate of prediction is considered as data for use in the group supervision etc. Also in case of group-supervising the elevators with the data expressive of the service condition, a similar drawback will arise.

SUMMARY OF THE INVENTION

This invention has been made in view of the above drawbacks, and has for its object to provide a control apparatus for elevators in which one cycle of a fluctuating demand is divided into a plurality of sections, the demand in each section or a service condition value of the elevators for the demand is measured, the demand or the service condition value of the corresponding section is estimated from the measured value, the estimated value is compared with a measured value obtained anew, so that when the compared result is decided to satisfy a first condition, cages may be controlled by the use of an estimative value obtained by considering the measured value obtained anew, whereas when the compared result is decided to fail to satisfy the first condition, the cages may be controlled by the use of the estimated value obtained without considering the measured value obtained anew, and measurement value analyzing means is comprised for analyzing the measured values which fail to satisfy the first condition, in the same section, so that when the analyzed result satisfies a second condition, the cages may be controlled by the use of the estimated value obtained on the basis of the measured value failing to satisfy the first condition, whereby the estimative value is caused to quickly follow up the fluctuation of the demand or the service condition value, to improve the responsiveness of the cages to the new demand or service condition value.

BRIEF DESCRIPTION OF THE DRAWINGS

FIGS. 3 to 11 show an embodiment of this invention, in which:

FIG. 3 is a block diagram showing a whole elevator system;

FIG. 4 is a memory map diagram of a random access memory;

FIG. 5 is a memory map diagram of a read-only memory;

FIG. 6 is a diagram showing the general flow of programs;

FIG. 7 is a flow chart of an initializing program;

FIG. 8 is a flow chart of an up direction demand calculating program;

FIG. 9 is a flow chart of a deciding program;

FIG. 10 is a flow chart of an average demand estimating program; and

FIG. 11 is a flow chart of an output program.

DESCRIPTION OF THE PERFERRED EMBODIMENT

Referring now to FIGS. 1 to 11, an embodiment of this invention will be described.

Figure 1:
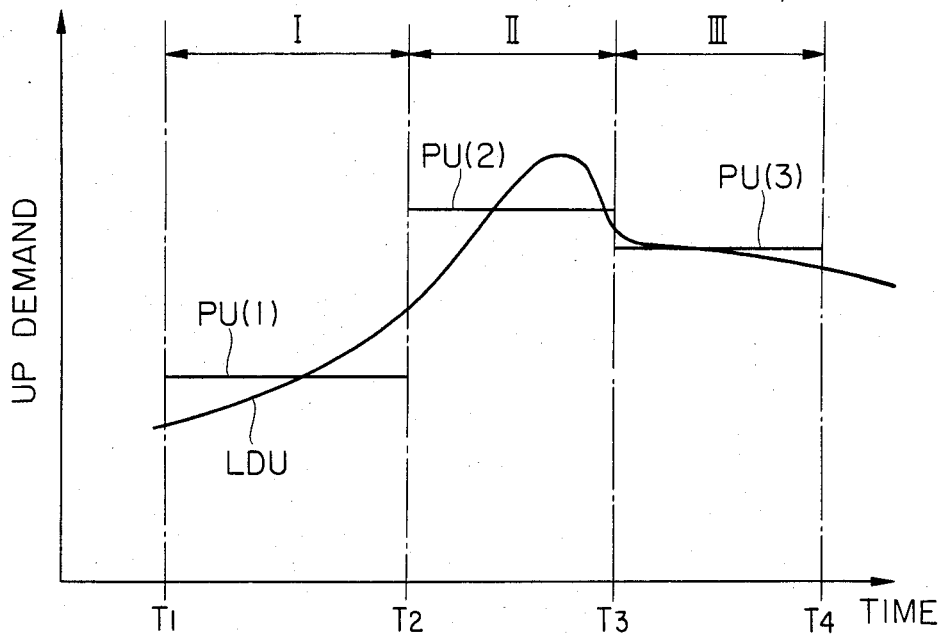
FIGS. 1 and 2 are explanatory diagram showing the fluctuations of traffic condition values concerning elevators.
Figure 2:
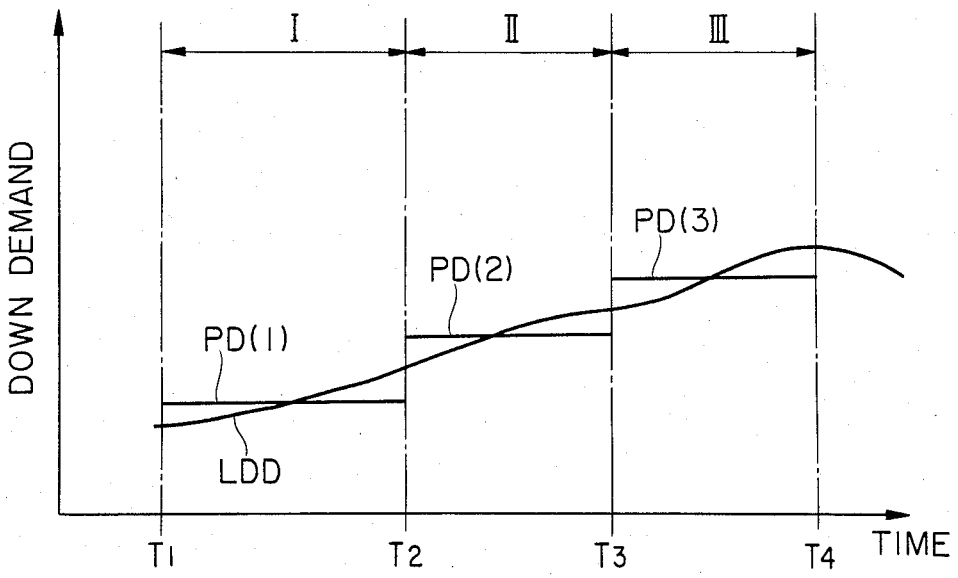

First, FIGS. 1 and 2 illustrate demands in the form of the numbers of persons who move in the up direction and down direction within a building, respectively. LDU indicates the up direction demand which is obtained in such a way that the numbers of persons moving in the up direction at predetermined times are measured and totaled for all floors, whereupon, the total values are cumulated every unit time DT (set at 5 minutes). Similarly, the down direction demand LDD is obtained in such a way that the numbers of persons moving in the down direction at predetermined times are measured and totaled for all the floors, whereupon the total values are cumulated every unit time DT. T1 denotes the boundary which is the starting time of a section I, T2 the boundary between the section I and a section II, and T3 the boundary between the section II and a section III, and T4 the boundary which is the end time of the section III. PU(1) and PD(1) designate an average up direction demand and an average down direction demand in the section I, respectively. They correspond to the average traffic volume $P_k(l)$ resulting when values obtained by cumulating the up direction demand LDU and the down direction demand LDD in the section I are respectively substituted into the column vectors $X_k^u(l)$ and $X_k^d(l)$ in equation (1), and the column vectors $Y_k^u(l)=0$ and $Y_k^d(l)=0$ are assumed. PU(2) and PD(2), and PU(3) and PD(3) similarly designate an average up direction demand and an average down direction demand in the section II, and an average up direction demand and an average down direction demand in the section III, respectively.

Figure 3:
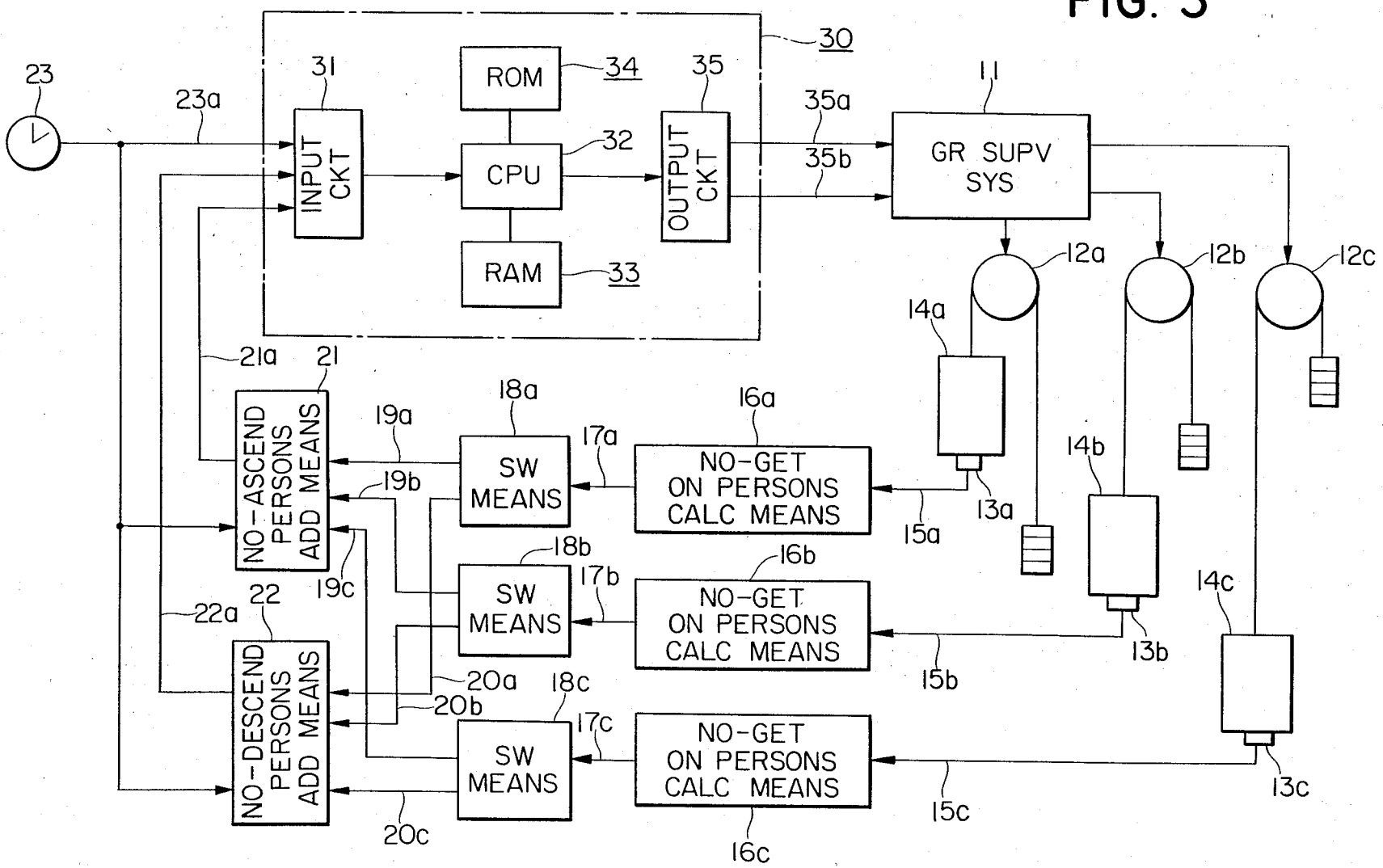

Referring now to FIG. 3, numeral 11 designates a group supervisory system which group-supervises three elevators 12*a*, 12*b* and 12*c*. Symbols 13*a*, 13*b* and 13*c* designate number-of-persons detection means which are constructed of well-known weighing devices disposed under the floors of the cages 14*a*, 14*b* and 14*c* of the elevators 12*a*, 12*b* and 12*c*, respectively. They provide number-of-persons signals 15*a*, 15*b* and 15*c* proportional to the actual numbers of passengers, respectively. Symbols 16*a*, 16*b* and 16*c* indicate number-of-getting on persons calculation means for calculating the numbers of persons who have gotten on the cages 14*a*, 14*b* and 14*c*, as disclosed in, e.g., the official gazette of U.S. Pat. No. 4,044,860. They detect the minimum values of the respective number-of-persons signals 15*a*, 15*b* and 15*c* at the times when doors (not shown) are open. Further, they subtract the minimum values of the number-of-persons signals 15*a*, 15*b* and 15*c* from the number-of-persons signals 15*a*, 15*b* and 15*c* immediately before the cages 14*a*, 14*b* and 14*c* start upon the closure of the doors, thereby to provide number-of-getting on persons signals 17*a*, 17*b* and 17*c*, respectively. Switching means 18*a*, 18*b* and 18*c* deliver the number-of-getting on persons signals 17*a*, 17*b* and 17*c* to signal lines 19*a*, 19*b* and 19*c* while the elevators 12*a*, 12*b* and 12*c* are continuing ascent operations, and they deliver these signals to signal lines 20*a*, 20*b* and 20*c* while the elevators are continuing descent operations, respectively. Numbers-of-ascending persons addition means 21 adds the respective number-of-getting in persons signals 17*a*, 17*b* and 17*c* inputted by the signal lines 19*a*, 19*b* and 19*c* and cumulates them for the unit time DT, and it provides an up-direction number-of-passengers signal 21*a* obtained by the cumulation. Numbers-of-descending persons addition means 22 adds the respective number-of-getting on persons signals 17*a*, 17*b* and 17*c* inputted by the signal lines 20*a*, 20*b* and 20*c* and cumulates them for the unit time DT, and it provides a down-direction number-of-passengers signal 22*a* obtained by the cumulation. Clock means 23 produces a timing signal 23*a* each time the unit time DT lapses, thereby to reset the up-direction number-of-passengers signal 21*a* and the down-direction number-of-passengers signal 22*a* to zero. Shown at numeral 30 is a demand estimation device which is constructed of an electronic computer such as microcomputer. It comprises an input circuit 31 which is constructed of a converter for receiving the up-direction number-of-passengers signal 21*a*, the down-direction number-of-passengers signal 22*a* and the timing signal 23*a*; a central processing unit 32 which operates and processes the respective signals received by the input circuit 31; a random access memory (hereinbelow, termed "RAM") 33 which stores data such as the operated results of the central processing unit (hereinbelow, termed "CPU") 32; a read only memory (hereinbelow, termed "ROM") 34 which stores programs, constant value data, etc.; and an output circuit 35 which is constructed of a converter for delivering signals from the CPU 32. Signal lines 35*a* and 35*b* transmit the signals of the output circuit 35 to the group supervisory system 11, respectively.

FIG. 4 shows the content of the RAM 33. Referring to the figure, numeral 41 indicates a memory area in which a time TIME obtained from the timing signal 23*a* is stored. A memory area 42 stores the up direction demand LDU which is the up-direction number-of-passengers signal 21*a* accepted, while a memory area 43 stores the down direction demand LDD which is the down-direction number-of-passengers signal 22*a* accepted. A memory area 44 stores a counter J which is used as a variable indicative of any of the sections I–III. A memory area 45 stores a distance X which is used as a variable expressive of the extent of the similarity between the estimated average demand and the measured average demand for each section. A memory area 46 stores a counter DAY which is used as a variable for counting a predetermined period of time. Memory areas 47–49 store the average up direction demands PU(1)–PU(3) in the sections I–III, respectively, while memory areas 50–52 store the average down direction demand PD(1)–PD(3) in the sections I–III, respectively. Memory areas 53–55 store predicted average up direction demands PUL(1)–PUL(3) which correspond to representative values $P_k(l)$ obtained by substituting the average up direction demands PU(1)–PU(3) into equation (4), respectively, while memory areas 56–58 store predicted average down direction demands PDL(1)–PDL(3) which correspond to representative values $P_k(l)$ obtained by substituting the average down direction demands PD(1)–PD(3) into equation (4), respectively. Memory areas 59–61 store the numbers of times of decision N(1)–N(3) to be used as variables for counting the numbers of times of decision by which the measured average demands have been decided to differ from ordinary magnitudes in the sections I–III, respectively. Memory areas 62–64 store flags FLAG(1)–FLAG(3) which are set at 1 (one) when the average demands measured in the sections I—III have been decided to differ from the ordinary magnitudes, respectively. Memory areas 65–67 store the numbers of elapsed days DAYX(1)–DAYX(3) to be used as variables for counting the numbers of days which have been elapsed since the decision of the change of the demand in the sections I–III, respectively.

FIG. 5 shows the content of the ROM 34. Referring to the figure, numerals 71–74 designate memory areas in which the boundaries T1–T4 set at 85 (=7:0.5), 99 (=8:15), 108 (=9:00) and 122 (=10:10) are stored, respectively. A memory area 75 store a weight coefficient SA which corresponds to the parameter a in equation (4) and which is set at 0.2. In a memory area 76, the reference value L for deciding the distance X is set at 400. Memory areas 77–79 store the initial values PU1–PU3 of the predictive average up-direction demands PUL(1)–PUL(3), which are set at 65 (passengers/5 minutes), 130 (passengers/5 minutes) and 109 (passengers/5 minutes), respectively. Memory areas 81–82 store the initial values PD1–PD3 of the predictive average down-direction demands PDL(1)–PDL(3), which are set at 5 (passengers/5 minutes),7 (passengers/5 minutes) and 20 (passengers/5 minutes), respectively. A Memory area 83 stores the predetermined period of time M which is set at 3 (days). A memory area 84 stores a reference value N for judging the numbers of times of decision N(1)–N(3), the value N being set at 2 (times). A memory area 85 stores a reference value Q for judging the numbers of elapsed days DAYX(1)–DAYX(3) which express the numbers of days elapsed since the decision of the change of the demand, the reference value Q being set at 10 (days).

Figure 6:
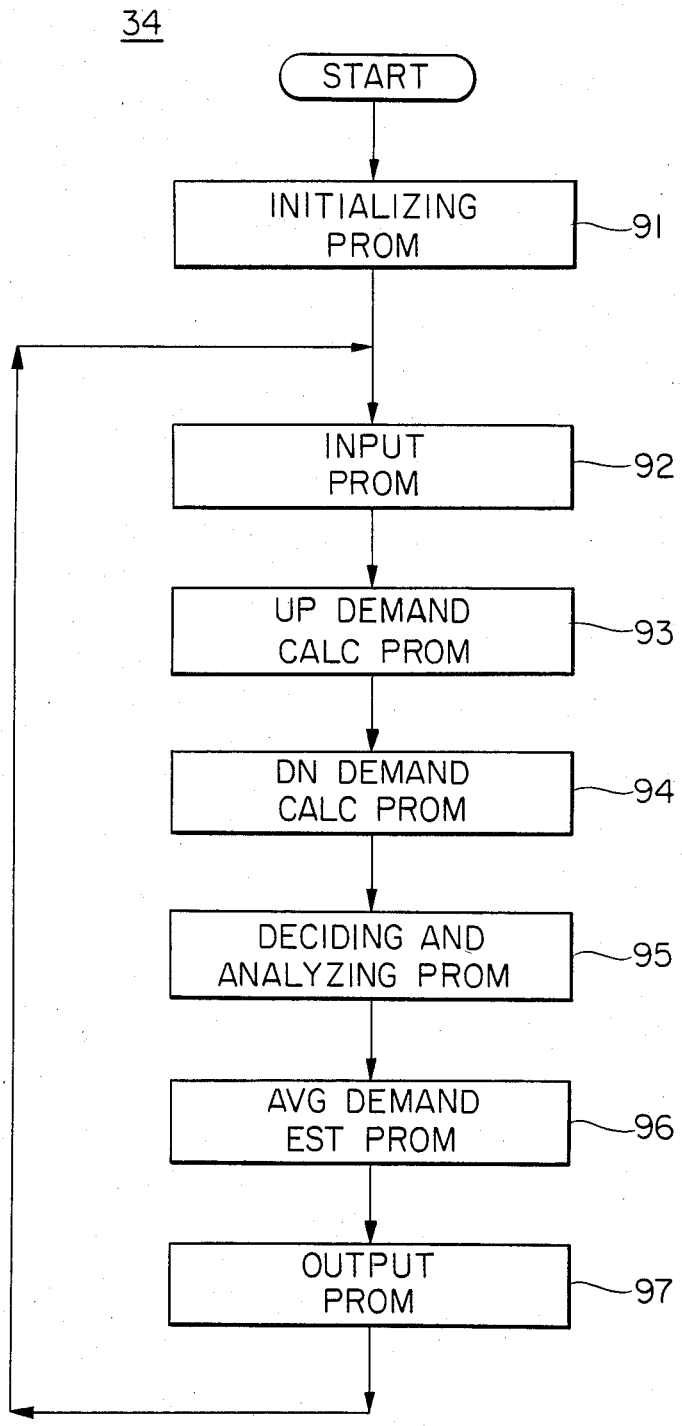
Figure 7:
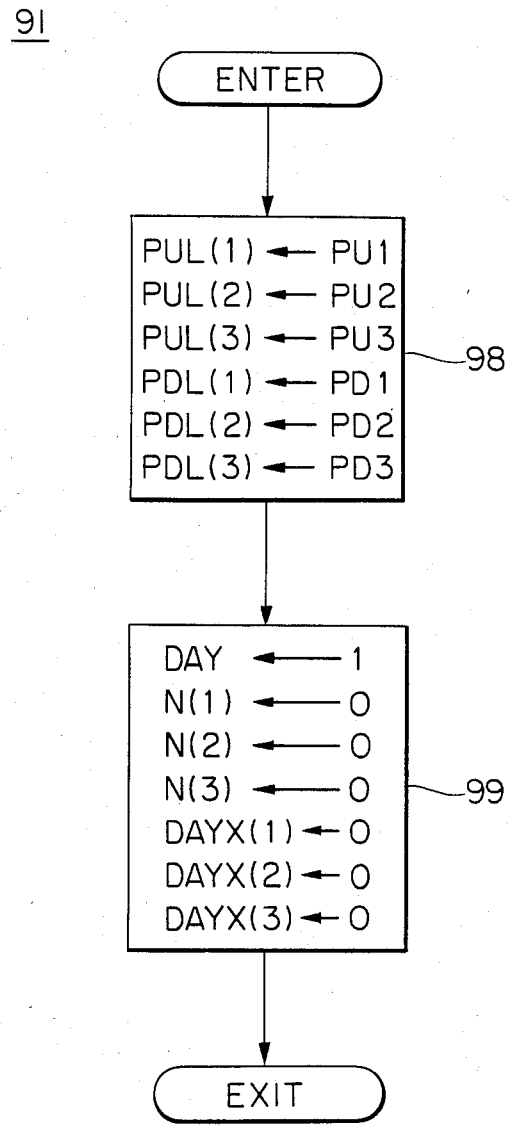
Figure 8:
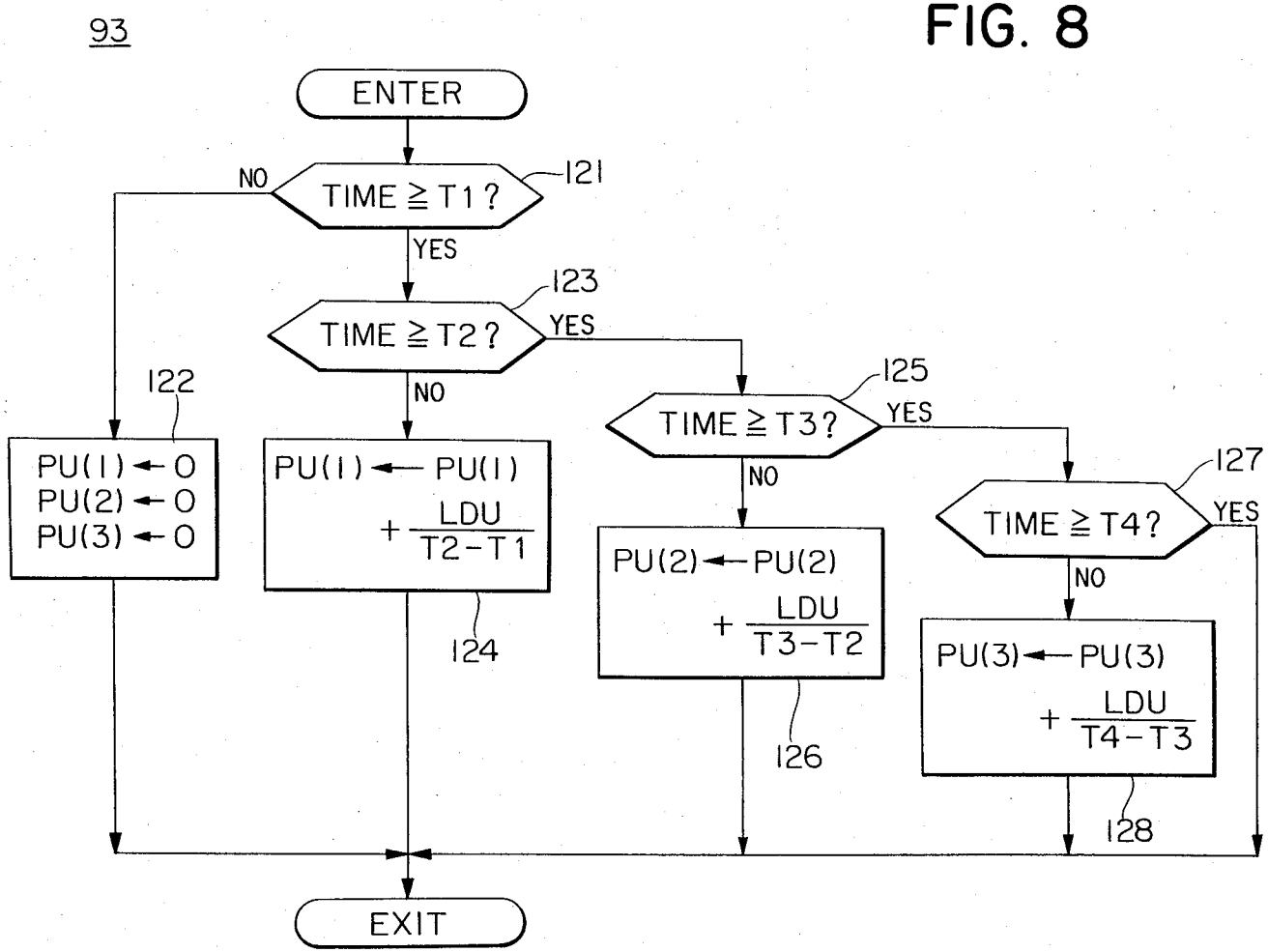
Figure 9:
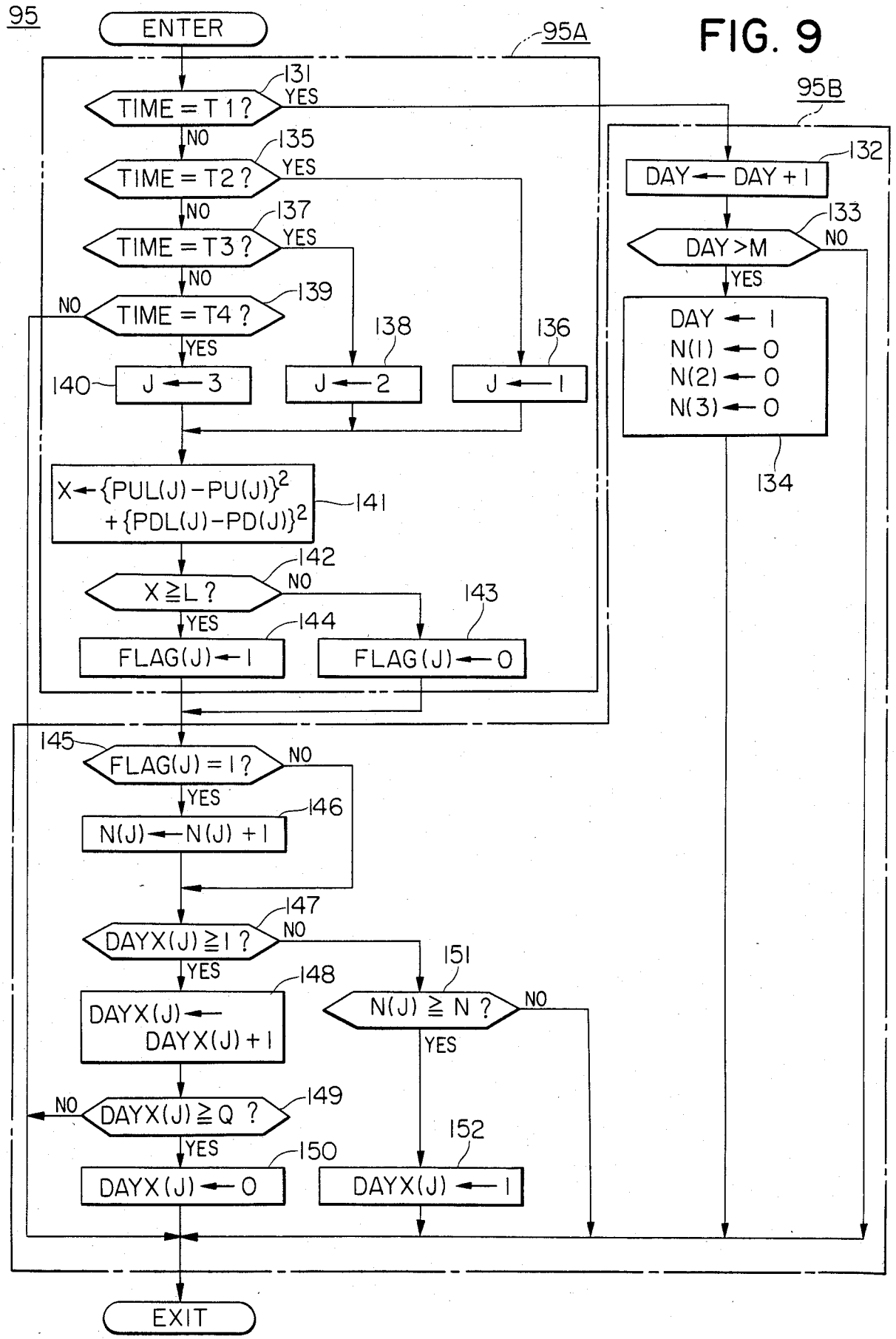
Figure 10:
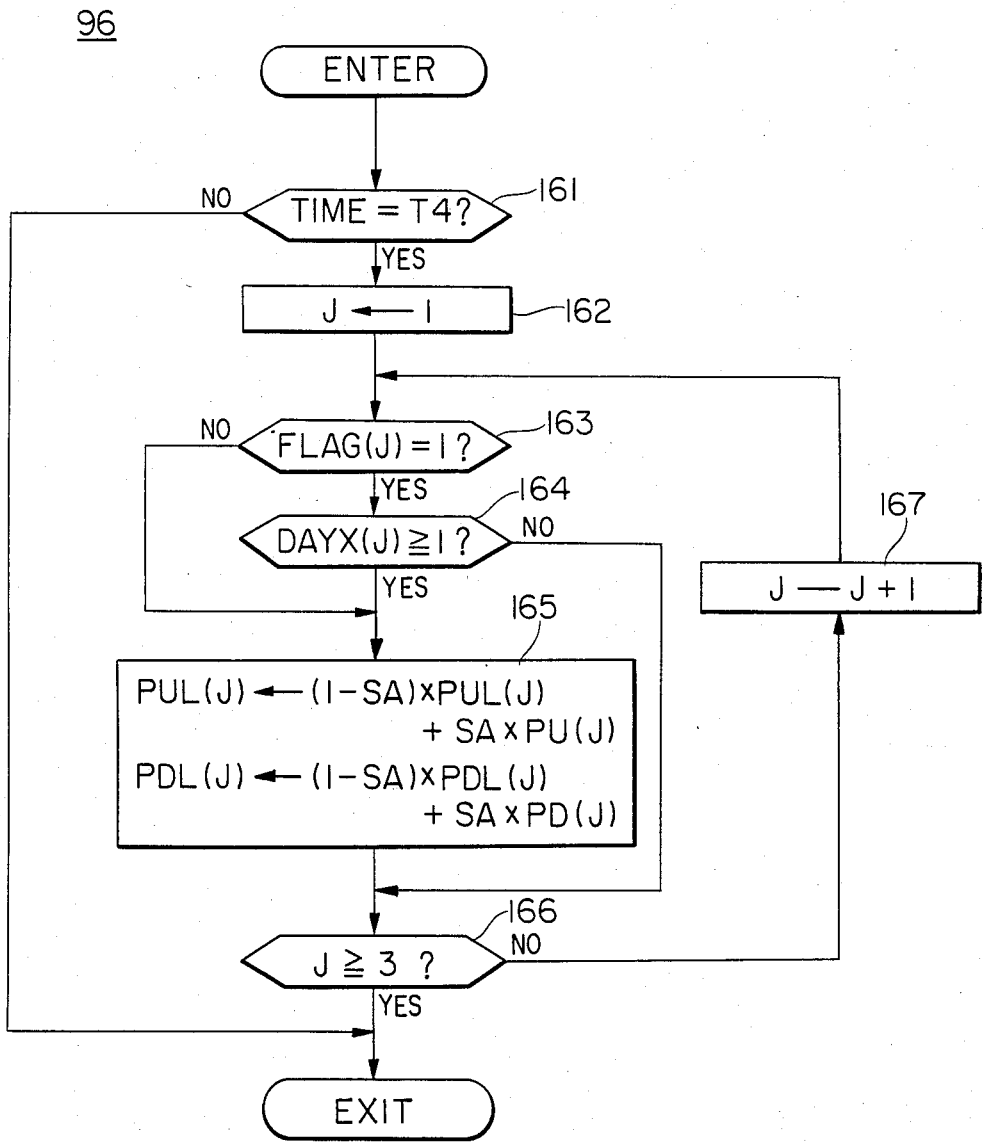
Figure 11:
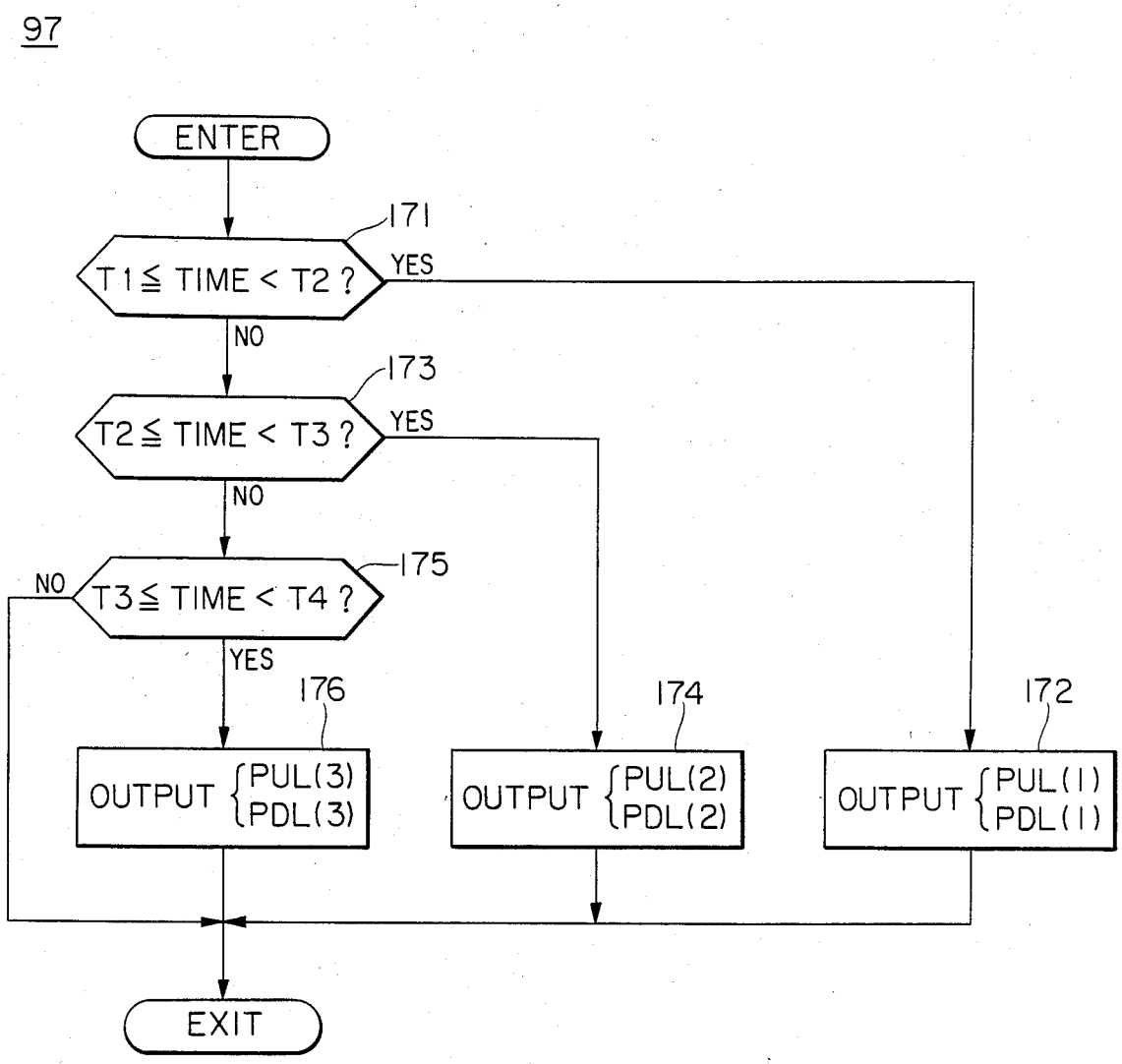

FIG. 6 illustrates the general flow of programs which are stored in the ROM 34 in order to estimate the average demand. Referring to the figure, numeral 91 designates an initializing program for setting the initial values of various data. An input program 92 accepts signals from the input circuit 31 and sets them in the RAM 33. An up demand calculating program 93 calculates the average up-direction demand PU(1)–PU(3) measured in the respective sections I–III, while a down demand calculating program 94 calculates the average down-direction demands PD(1)–PD(3) similarly to the above. A decision and analyzing program 95 consists of a deciding program which decides if the measured average demands PU(1)–PU(3), PD(1)–PD(3) differ from ordinary magnitudes and if the demand has changed, and an actual measurement value analyzing program which analyzes an actual measurement value. An average demand estimating program 96 calculates the predictive average up-direction demands PUL(1)–PUL(3) and predictive average down-direction demands PDL(1)–PDL(3) and in the respective sections I–III. An output program 97 transmits the predictive average up-direction demand PUL(1)–PUL(3) and predictive average down-direction demands PDL(1)–PDL(3) from the output circuit 35 to the group supervisory system 11 through the signal lines 35*a* and 35*b*, respectively.

The operations of the demand estimation apparatus constructed as thus far described will be described.

First, the numbers of persons who have gotten on the cages 14*a*–14*c* are respectively calculated by the number-of-getting on persons calculation means 16*a*–16*c*. Among these numbers of persons, the numbers concerning the ascent operations are applied to the numbers-of-ascending persons addition means 21, and the numbers concerning the descent operations are applied to the numbers-of-descending persons addition means 22, in such a manner that the number-of-getting on persons signals 17*a*–17*c* are switched by the switching means 18*a*–18*c*. The respective numbers of the persons who have gotten on the cages are added, whereupon the up-direction number-of-passengers signal 21*a* and down-direction number-of-passgengers signal 22*a* are provided and sent to the input circuit 31.

Besides, the number of counts produced when the value 1 (one) is counted every 5 minutes since a time 0 (zero) o'clock is provided as the timing signal 23*a* from the clock means 23, and it is sent to the input circuit 31.

On the other hand, when the demand estimation device 30 is first connected to a power source (not shown), the initializing program 91 is acutated. More specifically, as illustrated in detail in FIG. 7, at Steps 98, the initial values PU1–PU3 are respectively set for the predictive average up-direction demands PUL(1)–PUL(3), and the initial values PD1–PD3 are respectively set for the predictive average down-direction demands PDL(1)–PDL(3). At the next step 99, an initial value 1 (one) is set for the number of elapsed days DAY, an initial value 0 (zero) for the numbers of times of decision N(1)–N(3), and an initial value 0 (zero) for the numbers of elapsed days DAYX(1)–DAYX(3). Then, the control flow shifts to the input program 92.

The input program 92 is a well-known program which feeds the input signal from the input circuit 31 into the RAM 33. By way of example, when the time is 8 o'clock, the input program reads the value 96 from the input circuit 31 and shifts it to the memory area 41 so as to set the time TIME at 96. Likewise, the up-direction number-of-passengers signal 21*a* is accepted and stored as the up diirection demand LDU, while the down-direction number-of-passengers signal 22*a* is accepted and stored as the down direction demand LDD.

Next, the operations of the up demand calculating program 93 will be explained.

At Step 121, it is decided whether or not the time zone in which the average demand is to be calculated has been reached. When the time TIME is smaller than the boundary T1, the control flow proceeds to Step 122, at which all the average up-direction demands PU(1)–PU(3) are set at 0 (zero) as the initializing operation for the calculation of the average demand. When the time TIME becomes equal to or greater than the boundary T1 at Step 121, the control flow proceeds to Step 123. Whn the time TIME is smaller than the boundary T2 here, the control flow proceeds to Step 124, at which the average up-direction demand PU(1) of the section I is corrected by the use of the up direction demand LDU measured anew, so as to increase to the amount of the up direction demand per unit time DT (=5 minutes) as denoted by LDU/(T2–T1). When the time TIME is T2≦TIME<T3, the control flow proceeds along Steps 123→125→126, at which the average up-direction demand PU(2) of the section II is corrected in the same manner as at Step 124. Further, if the time TIME is T3≦TIME<T4, the control flow proceeds along Step 125→127→128, at which the average up-direction demand PU(3) of the section III is corrected in the same manner as at Step 124.

In this way, the average up-direction demands PU(1)–PU(3) of the sections I–III are sequentially corrected in the up demand calculating program 93.

The down demand calculating program 94 is a program which sequentially corrects the average down-direction demands PD(1)–PD(3) of the sections I–III likewise to the up demand calculating program 93. Since, it is readily understood from the up demand calculating program 93 stated above, it shall not be explained.

Next, the operations of the deciding and analyzing program 95 will be explained.

First, regarding the decision program 95A, when the time TIME has agreed with the boundary T1 which is the starting time of the section I, the control flow proceeds from Step 131 to the actual measurement value analyzing program 95B, and when the time TIME does not agree with the boundary T1, the control flow proceeds to Step 135 et seq. When the time TIME has agreed with the boundary T2 which is the end time of the section I (namely, the starting time of the section II), the control flow proceeds along Steps 131→135→136, at which the counter J is set at 1 (one). Step 141 calculates the distance X for comparing and deciding to what extent the average demands PU(1) and PD(1) measured in the section I are similar to the predicted average demands PUL(1) and PDL(1) obtained till then. For example, in a case where the average demands PU(1) and PD(1) are 70 (passengers/5 minutes) and 7 (passengers/5 minutes) respectively and where the predicted average demands PUL(1) and PDL(1) are set at 60 (passengers/5 minutes) and 10 (passengers/5 minutes) respectively, the distance X is calculated as $X=(60-70)^2+(10-7)^2=109$.

At the next Step 142, the distance X and the reference value L are compared. In the case of the distance X=109 as mentioned above, it is decided to be smaller than the reference value L (=400), and hence, the control flow proceeds to Step 143 for resetting the flag FLAG(1) of the section I to 0 (zero) and then to Step 145. In contrast, in a case where the average demands PU(1) and PD(1) have been respectively measured as 30 (passengers/5 minutes) and 2 (passengers/5 minutes) by way of example, the distance $X=(60-30)^2+(10-2)^2=964>$ reference value L (=400) holds, and hence, the control flow proceeds to Step 144. Here, the flag FLAG(1) of the section I is set at 1 (one) in order to express that the demand of the section I measured on the particular day differs in magnitude from the demand on the ordinary day.

When the time TIME agrees with the boundary T3 which is the end time of the section II, the control flow proceeds along Steps 131→135→137→138, at which the counter J is set at 2. When the time TIME agrees with the boundary T4 which is the end time of the section III, the control flow proceeds along Steps 131→135→137→138→140, at which the counter J is set at 3. Thereafter, the distance X is calculated as in the case of the section I, to investigate the change of the demand.

In this manner, the deciding program (95A) calculates, at the end times T2–T4 of the sections I–III, the flags FLAG(1)–FLAG(3) which express whether or not the average demands PU(1)–PU(3) and PD(1)–PD(3) measured in the respective sections I–III have magnitudes different from ordinary ones.

Next, the actual measurement value analyzing program 95B will be explained.

When the Step 143 or 144 of the deciding program 95A has ended, the flag FLAG(1) is checked at Step 145. Only when it is equal to 1 (one), the number of times of decision N(1) is increased by 1 (one) at Step 146. Thereafter, the number of elapsed days DAYX(1) is set by Steps 147–152.

Upon closure of a power supply, the number of elapsed days DAYX(1) is initialized to 0 (zero) in the initializing program 91. At first, therefore, the control flow proceeds from Step 147 to Step 151.

The number of times of decision N(1) expresses the number of times by which demands different from the ordinary magnitude have been measured in the section I during the predetermined period M (=3 days). When the number of times of decision N(1) has reached the reference value N (=2), the control flow proceeds from Step 151 to Step 152, at which the number of elapsed days DAYX(1) is set at 1 (one). On and after the next day, Step 147 is followed by Step 148, at which the number of elapsed days DAYX(1) is counted up by 1 (one) every day. When the predetermined period Q (=10 days) has been reached, the control flow proceeds from Step 149 to Step 150, at which the number of elapsed days DAYX(1) is set at 0 (zero) again. The reasons why the number of elapsed days DAYX(J) is reset to 0 (zero) upon the lapse of the predetermined period Q, are that the predictive average demands PUL(J) and PDL(J) are expected to have satisfactorily followed up a new changed demand in the period Q, and that the control is made ready for a still newer change of the demand.

When the time TIME has agreed with the boundary T1 at the Step 131 of the deciding program 95A, Step 131 is followed by Step 132, at which the number of elapsed days DAY is counted up by 1 (one). When the number of elapsed days DAY exceeds the predetermined period M (=3 days), Step 133 is followed by Step 134, at which the number of elapsed days DAY is reset to 1 (one) and the numbers of times of decision N(1)–N(3) are reset to 0 (zero).

In this manner, the actual measurement value analyzing program calculates the numbers of times N(1)–N(3) by which the average demands different from ordinary magnitudes have been measured during the predetermined period M, and the number of elapsed days DAYX(1)–DAYX(3) which express that the number of times of decision N(1)–N(3) has reached the reference value N, so the demands of the sections I–III have changed, and which also express the number of days elapsed since that time.

Now, the operations of the average demand estimating program 96 will be described.

Only when, at Step 161, the time TIME arrives at the boundary T4 which is the end time of the section III, the following Steps 146–167 are executed. At Step 162, the counter J is initialized to 1 (one). Here, when the average demands PU(1) and PD(1) measured in the section I, namely, at J=1 are decided to have the ordinary magnitudes of the average demands, that is, the flag FLAG(1)=0 holds, Step 163 proceeds to Step 165. Here, the predictive average up-direction demand PUL(J) calculated till the preceding day is multiplied by (1−SA) and is added to the average up-direction demand PU(J) just measured on the particular day as multiplied by SA, to set a predictive average up-direction demand PU(J) anew. Likewise, the predictive average down-direction demand PDL(J) is set again. When the average demands PU(1) and PD(1) measured in the section I have been decided to differ from ordinary average demands, that is, when FLAG(1)=1 holds, Step 163 proceeds to Step 164. Here, if the number of elapsed days DAYX(1) is 0 (zero) to express that the demand of the section I has not changed, the control flow proceeds to Step 166, and neither of the calculations of the predictive average up-direction demand PUL(1) and predictive average down-direction demand PDL(1) is executed. In contrast, if the number of elapsed days DAYX(1) is at least 1 (one) to express that the demand of the section I has changed, the control flow proceeds to Step 165, and the predictive average up-direction demand PUL(1) and predictive average down-direction demand PDL(1) are calculated as stated above.

At Steps 166 and 167, the counter J is increased one by one until the counter $J\geqq 3$ is established, and the calculations of Steps 163–166 are repeated for the sections II and III as in the case of the section I.

In this manner, according to the average demand estimating program 96, the predictive average demands are updated every day with the average demands measured for each section.

The predicted average up-direction demands PUL(1)–PUL(3) and predicted average down-direction demands PDL(1)–PDL(3) in the respective sections I–III as calculated in the way described above are transmitted from the output circuit 35 via the signal lines **35*a* and 36*a* to the group supervisory system 11 by the output program 97. First, in the section I ($T1\leqq TIME<T2$), the program proceeds along Steps 171→172, at which the predicted average up-direction demand PUL(1) in the section I is delivered onto the signal line 35*a* and the predicted average down-direction demand PDL(1) onto the signal line 35*b*. Likewise, in the section II ($T2\leqq TIME<T3$), the program proceeds along Steps 171→173→174, at which the predicted average up-direction demand PUL(2) and predicted average down-direction demand PDL(2) in the section II are respectively delivered onto the signal lines 35*a* and 35*b***.

In the section III (T3≦TIME<T4), the program proceeds along Steps 171→173"175→176, at which the predicted average up-direction demand PUL(3) and predicted average donw-direction demand PDL(3) in the section III are respectively delivered onto the signal lines 35*a* and 35*b*.

In this manner, according to the embodiment, even in the case where the average demand measured on the particular day differs greatly from the predictive average demand till then; when the number of times of the decision of the difference has reached the predetermined number of times N within the predetermined period M, the measured average demand is used for the calculation of the predictive average demand for the predetermined period Q since then. Therefore, even when the demand has changed greatly, the estimative value for the new demand can be calculated following it up.

Although, in the embodiment, the case has been exemplified where the demand obtained by totaling the up direction demand and down direction demand in the three sections is estimated, it is to be understood that this invention is also applicable to a case of predicting demands in four or more sections or a case of predicting demands for respective floors (in individual directions).

In the embodiment, the change of the demand is decided when the number of times by which the average demand measured in the predetermined period M has been decided to differe from an ordinary magnitude has become at least the predetermined number N, but the condition under which the change of the demand is detected is not restricted thereto. By way of example, a plurality of past measurement values as decided to differ from the ordinary magnitude are compared with one another by the use of, e.g., the norm of equation (6), whereupon the change of the demand may be detected when they are decided to be similar with differences smaller than a fixed value. In addition, although the predetermined period M, predetermined number of times N and predetermined period Q have been respectively set at values of 3 days, 2 times and 10 days, they are not respective. These quantities should desirably be set in consideration of the intended use of a building, the characters of respective floors, the number of floors, etc.

The control data for use in the group supervision is not restricted to the estimative value of the average demand mentioned above, but it may well be the average number of calls, or the average waiting time, the average maximum waiting time, the average number of times of passage due to the full capacity of passengers, or the like expressive of a service condition.

Further, although the boundaries T1–T4 have been fixed in the embodiment, this invention is also applicable to a case where they change with the changes of the demands.

The embodiment has been described as to the case where, when a measured result greatly differs from an estimated value till then, the measured result is not used for the calculation of an estimative value. This invention, however, is also applicable to a case where the value of a weight coefficient SA is set to be smaller than an ordinary magnitude, so as to use the above measured result for the calculation of the estimative value. As set forth above, according to this invention, one cycle of a fluctuating demand is divided into a plurality of sections, the demand in each section or a sevice condition value of elevators for the demand is measured, the demand or the service condition value of the corresponding section is estimated from the measured value, the estimated value is compared with a measured value obtained anew, so that when the compared result is decided to satisfy a first condition, cages may be controlled by the use of an estimative value obtained by considering the measured value obtained anew, whereas when the compared result is decided to fail to satisfy the first condition, the cages may be controlled by the use of the estimated value obtained without considering the measured value obtained anew, and measurement value analyzing means is comprised for analyzing the measured values which fail to satisfy the first condition, in the same section, so that when the analyzed result satisfies a second condition, the cages may be controlled by the use of the estimated value obtained on the basis of the measured value failing to satisfy the first condition. This brings forth the effect that the estimative value is caused to quickly follow up the fluctuation of the demand or the service condition value, to improve the responsiveness of the cages to the new demand or sevice condition value.

What is claimed is:

1. A control apparatus for elevators, comprising:

estimation means for dividing one cycle of a fluctuating demand into a plurality of sections, for measuring the demand in each section or a service condition value of the elevators for the demand, and for estimating the demand or the service condition value of the corresponding section from the measured value so as to deliver an estimated value;

decision means for comparing the estimated value with a measured value of the demand or a measured value of the service condition obtained anew, and for deciding a compared result;

means for delivering, when the compared result has been decided to satisfy a first condition, an estimative value estimated by said estimation means by using the measured value obtained anew, and delivering, when the compared result has been decided to fail to satisfy the first condition, the estimated value estimated by said estimation means without using the measured value obtained anew; and measurement value analyzing means for totalizing the measured values failing to satisfy the first condition, in the same section and for analyzing the totalization, so that when an analyzed result satisfies a second condition, cages may be controlled with the estimated value estimated by using the measured value failing to satisfy the first condition.

2. A control apparatus for elevators as defined in claim 1, wherein said decision means decides the satisfaction of the first condition by the new measured value when a difference between the estimated value and the new measured value is smaller than a certain magnitude, while it decides the failure to satisfy the first condition when the difference is larger than the certain magnitude.

3. A control apparatus for elevators as defined in claim 2, wherein said analyzing means analyzes whether the larger difference of the new measured value is based on a permanent change or a temporary change in the demand or the service condition, and in case of the permanent change, it decides the satisfaction of the second condition and causes said estimation means to perform the estimating operation by considering the new measured value.

4. A control apparatus for elevators as defined in claim 3, wherein said analyzing means decides the permanent change when the larger difference of the new measured value has arisen at least a predetermined number of times in a preset period of time.

5. A control apparatus for elevators as defined in claim 4, wherein said analyzing means includes means for counting the number of times by which the measured value differing greatly from the estimated value arises in the same section within the preset period of time.

6. A control apparatus for elevators as defined in claim 4, wherein said analyzing means commands said estimation means to find the estimated value by considering the new measured value, upon deciding that the permanent change has arisen; it commands said estimation means to find the estimated value without considering the new measured value, upon deciding that the temporary change has arisen; and it commands said estimation means to find the estimated value by considering the new measured value, when the larger difference is not involved.

7. A control apparatus for elevators as defined in claim 4, wherein said analyzing means starts counting the number of times anew when the preset period of time has ended.

8. A control apparatus for elevators as defined in claim 4, wherein upon deciding that the permanent change has arisen, said analyzing means continues to command said estimation means to perform the estimating operation by considering the new measured value, over a certain time interval longer than the preset period of time since the time of the decision.

9. A control apparatus for elevators as defined in claim 8, wherein when the certain time interval has ended, said analyzing means stops the continuation of the command to said estimation means.

10. A control apparatus for elevators as defined in claim 8, wherein said analyzing means includes means to start its operation when the permanent change has arisen, to thereafter calculate the certain time interval, and to provide a signal when the certain time interval has ended.

* * * * *